United States Patent [19]

Noble

[11] Patent Number: 4,632,168

[45] Date of Patent: Dec. 30, 1986

[54] METHODS AND LINED MOLDS FOR CENTRIFUGAL CASTING

[76] Inventor: Charles H. Noble, 2307 Manassas Dr., Birmingham, Ala. 35213

[21] Appl. No.: 534,614

[22] Filed: Sep. 22, 1983

[51] Int. Cl.[4] ..... B22C 9/24

[52] U.S. Cl. ..... 164/33; 164/114; 164/298

[58] Field of Search ..... 164/33, 138, 114, 286, 164/298, 299, 300, 301, 175, 176, 177, 178, 179

[56] References Cited

U.S. PATENT DOCUMENTS

| | | | |
|---|---|---|---|
| 2,731,690 | 1/1956 | Coupland | 164/114 |
| 3,110,944 | 11/1963 | Phelps | 164/114 |
| 3,944,193 | 3/1976 | Imai | 164/33 |
| 4,124,056 | 11/1978 | Noble | 164/33 |
| 4,150,709 | 4/1979 | Brugger | 164/114 |
| 4,240,492 | 12/1980 | Edwards | 164/34 |

FOREIGN PATENT DOCUMENTS

| | | | |
|---|---|---|---|
| 2902673 | 7/1980 | Fed. Rep. of Germany | 164/33 |
| 49-22286 | 6/1974 | Japan | 164/33 |
| 57-7261 | 5/1982 | Japan | 164/138 |
| 669492 | 7/1949 | United Kingdom | 164/33 |
| 829330 | 5/1981 | U.S.S.R. | 164/33 |
| 876258 | 10/1981 | U.S.S.R. | 164/138 |

*Primary Examiner*—Nicholas P. Godici
*Assistant Examiner*—G. M. Reid
*Attorney, Agent, or Firm*—Roylance, Abrams, Berdo & Goodman

[57] ABSTRACT

Reduction of porosity and control of graphitization in the centrifugal casting of tubular metal articles are achieved providing on the active surface of a metal mold by a densified and contoured lining of binderless particulate refractory material, at least 20% by weight of the particles in all of the lining being angular particles, at least 25% by weight of the particles in that portion of the lining in contact with the metal mold having predetermined particles size and/or thermal conductivity. The lining may comprise both a primary layer, formed of particles having good thermal conductivity and/or a relatively larger particle size, and a facing layer formed, e.g., of a milled refractory flour.

18 Claims, 8 Drawing Figures

METHODS AND LINED MOLDS FOR CENTRIFUGAL CASTING

This invention provides improvements in the centrifugal casting of tubular metal articles by methods in which a lining of finely particulate binderless refractory material is employed in a rotating metal mold.

BACKGROUND OF THE INVENTION

The centrifugal casting of tubular metal articles in a metal mold which has an inner surface of circular cross section and is rotated about an axis normal to that cross section is very old, iron pressure pipe having been cast in that fashion since the advent of the Delavaud and Sand Spun processes. Using centrifugal casting methods of this general type, it has become common practice to cover the inner or active surface of the metal mold with a lining of refractory material to protect the mold, to prevent the metal being cast from picking up material from the metal mold surface, and to allow the finished casting to be separated from the metal mold. In many prior-art methods, the refractory lining is formed by applying to the metal mold a particulate refractory material bound with a resin binder or an aqueous suspension of, e.g., bentonite, but, though such approaches have gained considerable acceptance, they have the disadvantages that the refractory lining is penetrated unduly by the molten metal being cast, that particules of the refractory material are picked up in the surface of the casting so that finish machining of the casting is difficult and expensive, and that it is difficult to control the thermal conductivity provided by the refractory lining in order to control the type and size of graphite in the metal of the casting. For a number of applications, the method disclosed in my U.S. Pat. No. 4,124,056 has overcome these disadvantages by using a binderless particulate refractory material to establish an initial refractory layer on the active surface of an unvented metal mold, densifying that layer under the action of centrifugal force applied by rotation of the mold, and contouring the densified layer to the precise shape desired for the cast article. That method is based upon the discovery that finely particulate refractory materials such as milled refractory flours, especially zircon flour, can be densified into a lining layer so stable that, e.g., the groove necessary to form an outer flange of the cast article can be cut into the layer with the walls of the groove remaining dimensionally stable after the groove has been formed, the particles of the refractory material after densification and contouring of the layer being packed so tightly together that the lining is at its maximum bulk density and will neither change in shape or be invaded by the molten metal during casting.

However, work with the method described in U.S. Pat. No. 4,124,056 has disclosed two surprising problems when the article to be cast is of such external shape that portions of the refractory lining are required to be radially thick in comparison to the thickness of the molten metal applied to such portions during casting. A first problem arises from the fact that, even through densified to maximum bulk density, the linings of binderless refractory particles contain enough internal voids to trap a significant volume of air and, when the casting temperature is low or the casting metal is thin relative to the refractory lining, trapped air, expanding because of the heat from the cast metal, is forced inwardly through the molten metal not just while that metal is in liquid state but also as the metal begins to solidify, so that undue porosity of the casting tends to occur. The second problem results from the superior insulating properties of, e.g., a lining formed of binderless zircon flour, and the second problem tends not only to accentuate the first but also to make control of graphite size difficult when the metal being cast is iron and specifications require close control of graphite size. Thus, when the article to be cast has a thin-walled portion adjacent, e.g., a thick transverse outwardly projecting flange, that portion of the lining which defines the thin-walled portion of the casting must be markedly thicker than that portion of the lining which defines the periphery of the flange, so that the thermal insulation presented by the lining surrounding the thin-walled portion of the casting is large in comparison with the thermal insulation provided by the lining at the flange. With the metal of the thin-walled portion therefore cooling more slowly, graphite growth in the thin-walled portion of the casting is accentuated. When casting iron blanks for engine cylinder liners, for example, specifications may call for the graphite flakes of the casting to be in a size range of 4–6, but slow heat loss in the thin-walled portion of the casting may result in size 3 graphite. Such large graphite flakes are objectionable because they tend to cause "pull-outs" during machining of the casting. There has accordingly been need for improvement.

Prior-art workers have proposed to control the thermal conductivity of refractory linings in various fashions, but success has been limited to those cases in which a binder was employed in the lining. Thus, it has been proposed to form portions of a refractory lining from different materials, so that one portion would have a different heat transfer capability than other portions, but this has been done only with, e.g., solid rings of high thermal conductivity material for one portion, and the use of solid rings is objectionable. It has also been proposed to use mixtures of different particulate refractory materials, the materials making up the mixture having different thermal conductivities, but this has heretofore not been possible in the case of linings formed without a binder because the particles of such a material tend to classify while the mixture is being applied to the mold surface, such inherent classification resulting in a lining which is not of uniform composition and is therefore unacceptable. Thus, when a mixture comprising a first material of relatively smaller particle size and a second material of large particle size is used, classification occurs according to particle size. Similarly, when particles of two materials of different specific gravity are used in the mixture, classification occurs because of the difference in specific gravity. When a portion of the tubular casting has a wall thickness small in comparison to the thickness of the corresponding portion of the refractory lining, the need for eliminating the air initially trapped in the refractory lining complicates the problem of controlling thermal conductivity of the lining portion when finely divided binderless refractory materials are used, since venting of the lining is difficult because of the tendency for fine particles to clog the air flow passages.

OBJECTS OF THE INVENTION

A general object of the invention is to increase the effectiveness and range of application of centrifugal casting methods which depend upon use of a mold lining formed of binderless particulate refractory material.

Another object is to achieve accurate and dependable control of the thermal conductivity of a mold lining throughout the entire length of the lining when the lining is formed of binderless particulate refractory material and to thus achieve control of the size and rate of graphite formation in the metal being cast.

Another object is to provide an improved method for avoiding objectionable porosity when casting centrifugally against a lining of binderless particulate refractory material.

A further object is to achieve better control of graphitization when casting iron against such a lining.

Yet another object is to achieve increased production rates when casting tubular articles of relatively small diameter against such linings.

A still further object is to provide on the cast article a surface having predetermined characteristics.

Another object is to provide improved centrifugal casting mold assemblies which provide better and selective control of heat transfer from the molten metal being cast to the metal mold.

SUMMARY OF THE INVENTION

All embodiments of the method are characterized by use of a refractory lining of binderless dry particulate refractory material which is applied to the active surface of the metal mold, then densified and contoured, with the lining being formed in such fashion that the heat conducting characteristics of selected axial portions of the lining are predetermined for proper control of graphitization in the metal being cast, the lining being so formed that at least 20% by weight of the particles in all portions of the densified and contoured lining are angular particles, and at least 25% by weight of the particles in that portion of the lining in contact with and immediately adjacent to the active surface of the metal mold differ from particles of milled refractory flour by at least one characteristic selected from the group consisting of markedly increased particle size and markedly increased thermal conductivity. In particularly advantageous embodiments, the lining is made up of at least one primary layer established directly on the active surface of the metal mold, and a facing layer on the inner face of the at least one primary layer, the particles of both the primary and facing layers containing at least 20% by weight of angular particles, the particulate material of the primary layer being chosen for control of thermal conductivity, and the facing layer being thinner than the at least one primary layer. In other embodiments, the lining comprises only a single layer made up either of particles of a refractory material such as crushed graphite or of a mixture of refractory materials, one of which is chosen for its thermal conductivity characteristics.

When the nature of the article to be cast is such that the problem of porosity due to escape of air from the refractory lining is severe, the metal mold is provided with a plurality of vents communicating between the internal space defined by the active mold surface and space external to the mold, and the higher permeability to gas flow of the primary layer provides for escape of the air within the pores of the lining. Thus, as the trapped air expands under the influence of heat from the casting metal, the air travels through the voids of the primary layer of the lining and escapes via the vents.

IDENTIFICATION OF THE DRAWINGS

DETAILED DESCRIPTION OF THE INVENTION

Figure 1:
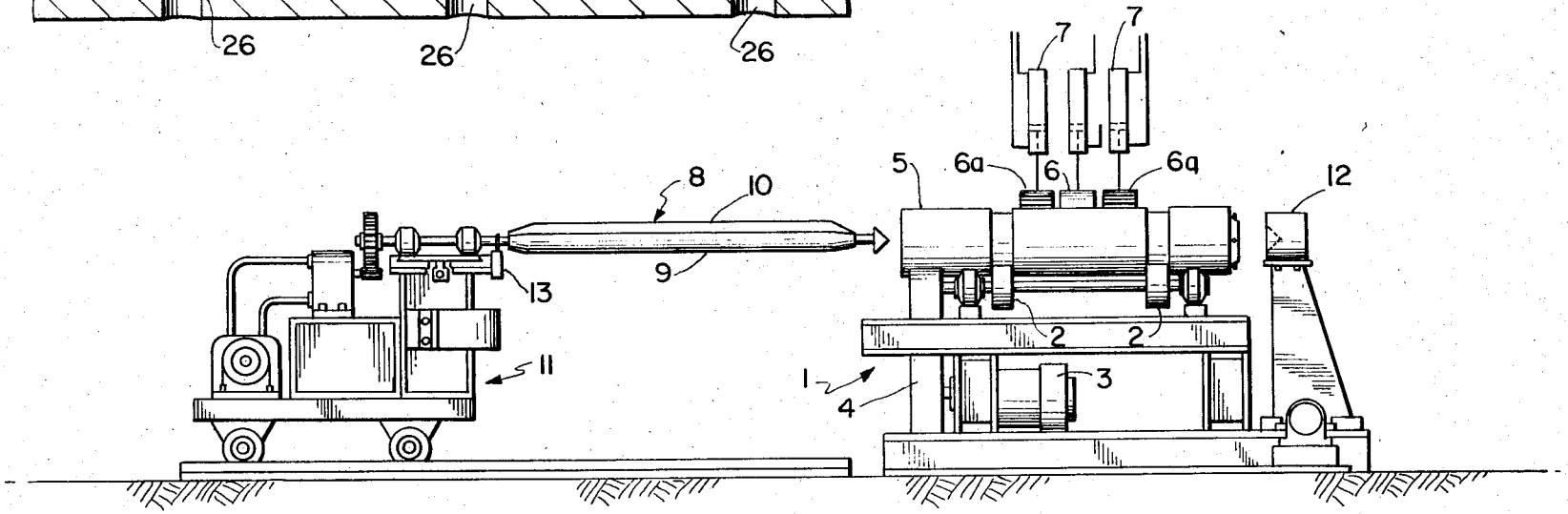
FIG. 1 is a semi-diagrammatic side elevational view of typical apparatus employed according to the invention.

The method is carried out by use of apparatus of the general type shown in FIG. 1, including a mold supporting and rotating unit, indicated generally at 1, having rollers 2 driven by a motor 3 via conventional variable speed drive 4, the rollers being arranged in spaced pairs to cradle the tubular metal mold 5. Hold-down rollers 6 are provided above the mold in conventional fashion, and engage the mold midway of its length. The supporting and rotating unit is also equipped with two sets of vibrator rollers *6a*, the two sets being spaced equally from the hold down rollers 6 each toward a different end of the mold, as shown. Vibrator rollers *6a* are grooved longitudinally so that, as rollers *6a* rotate at high speed because of their contact with the outer surface of mold 5, the mold is vibrated at a rate depending upon the diameter of the rollers, the number of the equally spaced grooves, and the speed of rotation imparted to the rollers by the mold. The force with which rollers *6a* are engaged with the mold is controllable, to control the amplitude of vibration, as by power cylinders 7. Mold 5 can be made as conventional steel centrifugal casting molds are made, but has a right circular cylindrical inner or active mold surface. As later explained, the mold can be either unvented or provided with a plurality of vents communicating between the space defined by the active mold surface and space external to the mold, the need for venting depending upon the nature of the casting to be produced.

Binderless dry particulate refractory material for lining the mold is introduced into the mold by a combined lining and contouring device indicated generally at 8 and including a trough 9 to carry and dispense the refractory material and a contouring blade 10 to shape the layer or layers of refractory material established on the active surface of the mold, device 8 being carried by a movable support 11 and so arranged that device 8 can be inserted through the mold and supported at its free end by bearing 12. The trough can be turned about its axis at a controlled rate to discharge the particulate material, and the contouring blade can be adjusted radially relative to the mold to bring it from an inactive position to a contouring position. A conventional pneumatic vibrator 13 is employed to vibrate through 9 as the particulate material is spilled from the trough onto the active surface of the metal mold to establish a lining layer preparatory to densification and contouring of the layer.

In casting tubular metal articles, such as engine cylinder liner blanks, against a densified and contoured lining of particulate refractory material such as the milled flours using equipment as just described, it has been found that, when the configuration of the article to be cast is such that, e.g., a right circular cylindrical portion must be cast against a refractory lining portion which has a thickness equal to about 50% of the thickness of the molten metal layer, success is difficult to achieve, both because the air entrapped in the refractory lining is still escaping into the casting metal as the metal begins to solidify and therefore tends to cause undue porosity, and because the insulating effect of the relatively thick layer of refractory material cools the molten metal too slowly, with the result that the graphite size in the finished casting is too large. The problems arise because such materials as zircon flour, being very fine, have a reduced capacity for conducting heat. Also, though such materials are capable of being densified to such an extent that the particles are packed so tightly as not to be invaded by liquid metal, even adequately densified linings of such material still have, e.g., 30% void space by volume and therefore carry a substantial amount of trapped air at the time the lining is contacted by the molten metal being cast. Yet the finely particulate nature of such materials makes the total lining quite resistant to permeability to gas flow, and it has been difficult to eliminate the trapped air by venting.

Both problems are solved according to the invention by providing a refractory lining of free-flowing binderless particulate refractory material on the active surface of the metal mold, densifying the lining by rotating the mold at a rate to apply to the refractory material a centrifugal force of such magnitude that the refractory material has an equivalent specific gravity of at least 7.5 determined according to the formula $$\text{Eq. Sp. Gr.} = \text{Actual Sp. Gr.} \times G$$

where G is determined by the formula $$G = \frac{[(RPM)^2 \times D]}{70{,}400}$$

where D is the inner diameter of the refractory layer in inches, contouring the densified lining to the shape desired for the outer surface of the article to be cast, and then casting against that refractory lining, when at least 20% by weight of the particles in all portions of the lining are angular particles, i.e., particles that are sharp rather than rounded, and at least 25% by weight of the particles in that portion of the lining in contact with and immediately adjacent to the active surface of the metal mold differ from particles of milled refractory flours (taken as a standard of reference) by having either or both a markedly increased particle size and/or a markedly increased thermal conductivity.

According to one embodiment of the invention, it has been found that such a lining can be successfully established when the major portion of the lining is first established on the active surface of the metal mold as at least one primary layer of free-flowing binderless particulate refractory material having a particle size providing high permeability to gas flow and high thermal conductivity, densifying the at least one primary layer and contouring the densified layer to a predetermined shape at least approximately that desired for the article to be cast, then establishing on the inner face of the at least one primary layer a facing layer which is also of free-flowing binderless particulate refractory material but which will impart the desired surface characteristics to the casting, the facing layer being densified and then contoured to the precise shape desired for the article to be cast. Surprisingly, the facing liner is of such stability that casting can be accomplished, even when the at least one primary layer contains particles of relatively large size and is so permeable that casting metal would tend to invade the lining if cast in direct contact therewith, and the facing layer can be made very thin, so thin as to barely mask the at least one primary layer, and in all events thin in comparison to the thickness of the at least one primary layer.

The at least one primary layer and the facing layer must each be of particulate refractory material containing at least 20% by weight of angular particles. The at least one primary layer can be of a single material, such as crushed graphite or sharp silica sand, or a uniform mixture of one particulate refractory material the particles of which are angular and a second particulate refractory material having large particles which need not be angular. Thus, a mixture of at least 20% by weight of a milled refractory flour with Florida zircon sand can be used. Advantageously, when both high thermal conductivity and high permeability to gas flow are to be achieved, the at least one primary layer is of a particulate refractory material or mixture of materials having a particle size distribution such that at least 25%, most advantageously at least 40%, by weight of the particles have a maximum dimension exceeding 212 microns. An optimum combination of thermal conductivity and permeability to gas flow through the layer is achieved when the larger particles, i.e., particles having a maximum dimension exceeding 212 microns, advantageously exceeding 300 microns, are in particle-to-particle contact substantially throughout the thickness of the lining, whether the larger particles are angular or rounded.

When the article to be cast is required to have an especially smooth cast surface, the facing layer advantageously is of a milled refractory flour such as zircon flour, silica flour, mullite flour, a flour of magnesium oxide, a graphite flour or equivalent materials. When machining of the cast article is to be minimized and the possibility of refractory particles in the cast surface completely avoided, the particles of the refractory flour should not be larger than 106 microns. Advantageously, when smoothness of the cast surface is to be achieved, at least 40% by weight of the particles of the facing layer should be angular particles, and especially good results are achieved when the angular particles do not exceed 75 microns.

When the surface of the cast article defined by the facing layer is to be rough, as when the article is to be held by an inflatable gripper during machining, the facing layer can be formed of particulate refractory material comprising particles which are relatively larger. Thus, the facing layer can be of a mixture of a milled refractory flour and a sand, with the proportions being such that not more than about 60% of the total particles have a maximum dimension exceeding 150 microns. Thus, to achieve rough cast surfaces, the facing layer can be of a uniform mixture of 40–90% by weight of a milled refractory flour and, correspondingly, 60–10% by weight of a sand.

When the refractory lining must include relatively thick areas, as the areas to define an elongated cylindrical surface, and relatively thin areas, as the areas to define outwardly projecting flanges, use of both at least one primary layer and a facing layer makes it possible to control the insulating effect of the lining, and therefore the rate at which the casting metal cools, throughout the length of the lining. Thus, the facing layer can be thin over those portions of the at least one primary layer that are to define the elongated cylindrical surfaces and thicker over those portions that are to define the peripheries of the flanges, and the relative thicknesses of the portions of the facing layer can be such that all portions of the casting metal are cooled at substantially the same rate.

The invention is particularly advantageous when it is necessary to provide at the interface between the molten casting metal and the mold a particulate chemical agent, such as a de-gassing agent. In such cases, the facing layer advantageously is formed of a uniform mixture of finely particulate binderless refractory material and the particulate chemical agent, with the refractory material making up 20–90% of the weight of the mixture. Thus, for example, the treating agent may be that de-gassing agent known in the trade as calcium/silicon, a particulate solid material comprising calcium, silicon and, e.g., carbon or barium, with a particle size distribution such that a substantial proportion is finer than 106 microns.

The invention is of most importance when the metal mold has a right circular cylindrical active surface and the article to be cast has a cylindrical outer surface portion and at least one transverse annular outwardly projecting portion, such as a flange, which is of larger diameter than is the cylindrical surface portion. In such cases, since the active surface of the metal mold must be slightly larger in diameter than the periphery of the flange or like outwardly projecting portion of the cast article, so that the cast article can simply be pulled from the mold, the portion of the refractory lining which defines the cylindrical surface portion of the casting must have a radial thickness greater than the radial dimension of the flange or the like, that thickness being dictated by the need for freedom to pull the cast article rather than by need for thermal insulation. When linings formed of binderless particulate refractory material are relatively thin, porosity due to air trapped initially in the lining is usually not a severe problem, since the air is free to escape through the molten metal of the casting before the metal begins to solidify. However, when the radial thickness of the refractory layer is equal to at least 50% of the thickness of the layer of molten metal being cast, so that a larger amount of air is initially trapped in the lining, a substantial amount of air remains in the lining when the casting metal begins to solidify, and that air tends to enter the molten metal as the metal is solidifying, resulting in objectionable porosity in the casting. Liners formed according to the invention assure that, even in relatively thick portions of the lining, the trapped air is free to flow through the lining to escape from the mold via suitable vents. And, with the trapped air eliminated without causing porosity in the cast metal, the faster chilling rate, resulting from improved thermal conductivity of the lining, does not result in porosity since the trapped air does not attempt to escape via the molten metal.

Though establishment of substantially uniform layers of particulate materials such as zircon flour or silica flour can be accomplished without special difficulty, since such materials are characterized by angular particles and fine particle size, e.g., with not more than a few percent by weight of the particles having dimensions exceeding 200 microns, achieving uniformity within the layer and dimensional stability of the layer become difficult when the range of particle sizes increases and larger particles are present, particularly when a substantial proportion of the particles are rounded rather than angular. Thus, when a substantial quantity of such particulate material is deposited at once upon the active surface of the rotating metal mold, tumbling of the quantity occurs near the mold surface, with the result that separate phases of larger and smaller particles tend to occur with the larger particles concentrating at the inner surfaces of the resulting layer. This problem is avoided according to the invention by feeding the particulate material from a supply device, typically a trough, in such fashion that the particulate material travels to the mold surface in the form of a thin stream so that only a small quantity of particles arrives at the mold surface or at the forming layer at any one time and the particles are fixed in place by centrifugal force. Advantageously, the rate of turning of the trough is such that, for the speed of rotation of the mold, only enough particulate refractory material is supplied to form on the mold or the forming layer a layer of refractory particles having a radial thickness of from one to several times the average largest particle dimension, the optimum being to establish, at any one instant, a layer which is only one particle thick. Advantageously, both the metal mold and the trough or other supply device are subjected to high frequency low amplitude vibration during supply of the material and establishment of the layer.

Figure 2:
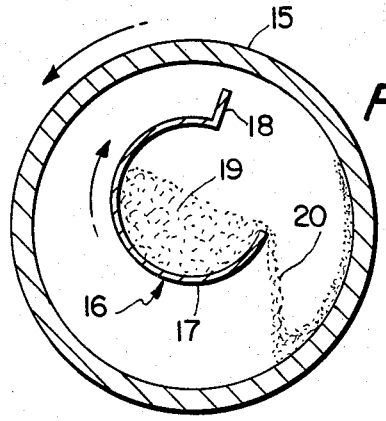
FIGS. 2–2C are diagrammatic cross-sectional views illustrating the manner in which refractory layers are provided on a centrifugal casting mold according to the invention.
Figure 2A:
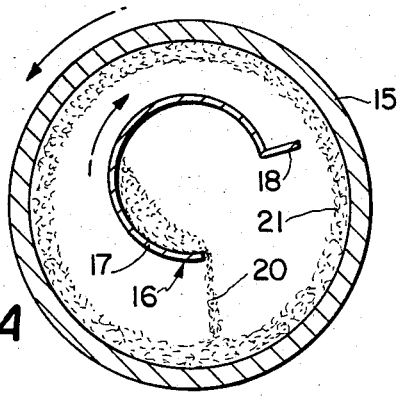
Figure 2B:
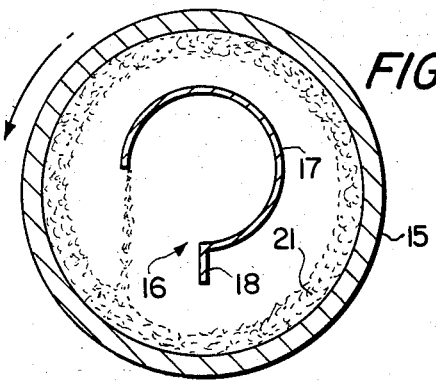
Figure 2C:
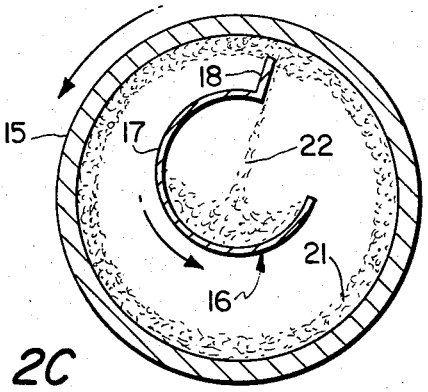

FIGS. 2–2C illustrate diagrammatically the manner in which the primary layer is estblished and contoured, the metal mold being indicated at 15 and a combined feeding and contouring device at 16. Device 16 can be constructed generally as disclosed in U.S. Pat. No. 4,124,056 and includes an elongated trough 17 and an elongated contouring blade 18, the active edge of the blade having a profile of the shape for the inner surface of the layer being established. Device 16 is supported for insertion and withdrawal axially of mold 15 and for both rotational adjustment about its longitudinal axis and vertical adjustment relative to the mold. After being loaded with refractory material 19 and inserted axially into the mold, and while the mold is rotating (counterclockwise in the diagrams of FIGS. 2–2C) at a rate adequate to generate centrifugal force sufficient to cause the particulate refractory material to adhere to and travel with the metal mold, device 16 is raised to the position seen in FIG. 2, so that its axis is above that of the mold, and then turned clockwise about its axis slowly, while the trough is vibrated by device 13, FIG. 1, causing a thin stream 20 of the particulate refractory material to be fed by gravity over the rim of the trough onto the active mold surface. At any one time, stream 20 includes only a relatively small increment of the total particulate material to be supplied to establish the primary layer 21. The trough is turned continuously through half a rotation, so that stream 20 continues to be fed, with the layer 21 building up as seen in FIG. 2A until, as shown in FIG. 2B, all of the particulate material needed has been supplied. When layer 21 has been densified, as by increasing the rate of rotation of the mold to give the refractory material of the layer an equivalent specific gravity of at least 7.5, as above explained, or by continuing to rotate the mold at such a rate when that rate was initially employed, device 16 is turned counterclockwise to bring the active edge of the blade into contouring engagement with layer 21, excess particulate refractory material being deflected, as indicated at 22, back into the trough. When contouring has been completed, the contouring blade again extends vertically upwardly, device 16 is then lowered until its axis coincides with that of the mold, and device 16 is withdrawn axially from mold 15, leaving layer 21 in densified and contoured form, ready to receive either an additional primary layer or the facing layer (not shown in FIGS. 2–2C).

In many cases, only a single primary layer will be required and that layer can be contoured to the precise shape desired for the article to be cast. In other cases, as when the first primary layer must be such as to present, e.g., maximum permeability to gas flow and therefore only the minimum mechanical strength required to preserve dimensional stability until a second, strengthening primary layer is applied, a second primary layer of a different composition of refractory particles is applied to the first layer, proceeding as described with reference to FIGS. 2–2C save that the location of device 16 for contouring the second layer is appropriately changed and, if necessary, a contouring blade with a modified profile is used for contouring.

The facing layer is applied and contoured in the same general manner described for the primary layer. When the at least one primary layer is contoured to a shape differing from that to be imparted to the cast article, a replacement contouring blade, with a profile identical to the shape desired for the article to be cast, must be used to contour the facing layer. When the at least one primary layer has been contoured to the precise shape for the article to be cast, the same blade is used to contour the facing layer as was used to contour the next adjacent primary layer, and the contouring position of device 16 for the facing layer is backed off according to the thickness desired for the facing layer. Surprisingly, very thin facing layers can be established, densified and contoured with the thin layer remaining persistent and dimensionally stable, and without the material of the facing layer significantly invading the primary layer. Thus, particularly when the facing layer is of a milled refractory flour or of a mixture of such material and a very finely particulate chemical agent, such as calcium/silicon, the particulate material of the facing layer can, in effect, simply be wiped into the surface of the at least one primary layer so that the facing layer is but a few thousandths of an inch in thickness.

Figure 3:
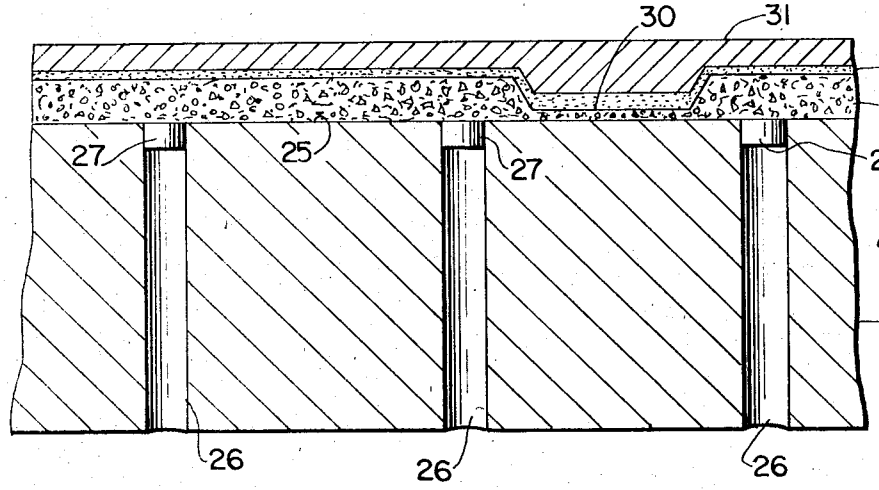
FIG. 3 is a diagramatic fragmentary longitudinal cross-sectional view of a composite refractory lining according to one embodiment of the invention.
Figure 4:
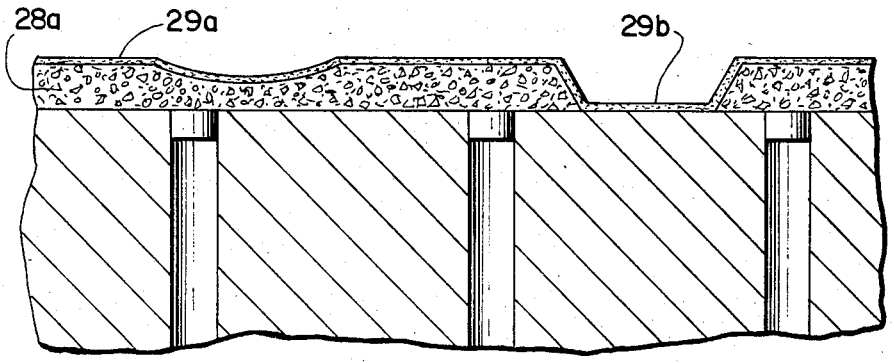
FIG. 4 is a view similar to FIG. 3 illustrating another embodiment.

In the case of, e.g., a cast article having a main right circular cylindrical surface portion and a transverse annular end flange, the at least one primary lining can be continuous for the full length of the casting, with the lining being relatively thick in that portion corresponding to the cylindrical portion of the cast article and relatively thin where the flange is to be cast. In that event, the facing layer will be a continuous layer extending over both the thicker and thinner portions of the primary layer as seen in FIG. 3 and, depending upon the requirements for the particular article to be cast, either of one thickness or of varying thickness. Thus, it is advantageous for the facing layer in many instances to be as thin as practical where the cylindrical surface portion of the article is to be cast and significantly thicker where the periphery of the flange of the article is to be cast, as seen in FIG. 3. In other cases, the at least one primary layer may be completely or essentially omitted in the area of the periphery of the flange of the article to be cast, and the facing layer will then cover all of the primary layer plus that exposed or essentially exposed portion of the active surface of the metal mold where the flange of the cast article is to be located, as illustrated in FIG. 4.

When it is not necessary that the external surface of the cast article be especially smooth, as when the cast article is to be clamped in an inflatable gripper during machining of the bore, the refractory lining can comprise a single layer, without a facing layer, with the single layer formed of only one particulate refractory material, advantageously crushed graphite, or of a mixture of materials, such as a milled refractory flour amounting to at least 20% by weight of the mixture and a sand making up the balance of the mixture.

The following examples are illustrative:

EXAMPLE 1

Apparatus generally in accordance with FIG. 1 is employed to support and rotate a steel mold 5, FIG. 3, having a right circular cylindrical inner or active surface 25 and a plurality of radial vent bores 26 each communicating between the space defined by surface 25 and the space surrounding the mold, each bore 26 being equipped at its inner end with a conventional particle filter 27. Proceeding as described with reference to FIGS. 2–2B a single primary layer 28 is established, using as the free-flowing binderless particulate refractory material a commercially available particulate graphite obtained by crushing used graphite furnace electrodes and having the following particle size distribution:

| MESH (U.S. Sieve Series) | SIEVE OPENINGS (Microns) | PERCENT BY WEIGHT |
|---|---|---|
| 30 | 600 | 2.2 |
| 40 | 425 | 20.1 |
| 50 | 300 | 21.1 |
| 70 | 212 | 17.3 |
| 100 | 150 | 13.0 |
| 140 | 106 | 10.3 |
| 200 | 75 | 8.2 |
| 270 | 53 | .6 |
| Pan | — | 7.2 |

Essentially all of the graphite particles are angular, including face shapes generally in the form of rectangles, triangles and rods. The material exhibits an angle of repose of 37½° and a void volume of 44% determined by first subjecting a sample of the material to 100 shocks with a conventional laboratory compactor and then determining the volume of water which the compacted sample will accept and retain.

With the active surface 25 of the metal mold having a diameter of 5.70 inches, the mold is rotated at 500 r.p.m. Vibrator rollers 6a, FIG. 1 have an outside diameter of 5½ inches and bear on a portion of the metal mold having an outer diameter of 7½ inches. The vibrator rollers each have 50 longitudinally extending peripheral grooves each ⅛ inch wide and ⅛ inch deep, so as to impart vibration to the metal mold at a frequency of 34,000 cycles per minute. With the mold rotating continuously at 500 r.p.m., the crushed graphite is supplied in accordance with FIG. 2, device 16 being vibrated generally circumferentially by a conventional pneumatic vibrator at 12,700 cycles per minute. Once device 16 has been inserted into the metal mold, trough 17 is rotated at a very slow rate to feed a continuous thin sheet-like stream or film of the graphite onto the mold surface until a uniform layer 28 of a thickness slightly in excess of 0.4 inch has been established, the 500 r.p.m. rotation rate of the mold being adequate to densify layer 28 as it is formed. The speed of mold rotation is then increased to 1000 r.p.m., and blade 18 is operated to contour layer 28 to the shape shown, so as to include at least one groove 30, with the thicker portions of the layer being 0.265 inch thick.

To demonstrate thermal conductivity of the primary layer of graphite, 100 lbs. of molten metal for grey iron casting is melted at 2880° F. and, while metal mold 5 is at 475° F., the molten metal is poured at 2645° F. to provide a radial thickness of molten metal on layer 28 equal to 0.4 inch. Using a conventional recording optical pyrometer operating at a record feed rate of 2 inches per minute, the time for the temperature of the casting metal to fall to the eutectic point is approximately 1.9 inches (0.95 minute) and the additional time for the temperature to fall to 100° F. below the eutectic point is approximately 1.4 inches (0.7 minute).

A crushed graphite primary layer the same as layer 28 is again prepared except that the primary layer is contoured to a thickness 0.075 inch less than that for the first graphite layer. The refractory liner is then completed, following the procedure of FIGS. 2–2C, by establishing and contouring a facing layer 29, FIG. 3, of zircon flour, the thickness of the facing layer after contouring being 0.075 inch, mold rotation rates and vibration being the same as earlier described in this example. The particle size distribution of the zircon flour is as follows:

| MESH (U.S. Sieve Series) | SIEVE OPENINGS (Microns) | PERCENT BY WEIGHT |
|---|---|---|
| 200 | 74 | 2.5 |
| 325 | 43 | 11.0 |
| 400 | 38 | 6.7 |
| Through 400 mesch | Smaller than 38 | 78.9 |

The zircon flour is a milled product, so that essentially all of the particles are angular, and exhibits an angle of repose of 30° and a void volume of 30%.

Metal 31 is poured precisely as earlier described in this example, and the optical pyrometer used to determine the cooling rate. Time to the eutectic point is approximately 5.9 inches (2.95 minutes) and time to 100° below the eutectic point is an additional 3.9 inches (1.95 minutes), illustrating the marked slowing of the cooling due to the presence of the thin layer of zircon flour.

The cast article cast against the composite liner comprising primary layer 28 and facing layer 29 is free from porosity and has a smooth cast surface essentially free from refractory material.

EXAMPLE 2

The lining described in Example 1 is reproduced, save that primary layer 28 is formed of a uniform mixture of 40% by weight zircon flour and 60% by weight Florida zircon sand.

EXAMPLE 3

The lining described in Example 1 is reproduced but with the primary layer 28 formed of sharp silica sand.

EXAMPLE 4

The lining described in Example 1 is reproduced with primary layer 28 formed of the crushed graphite specified in Example 1 and the facing layer 29 formed of a uniform mixture of 50% by weight of the zircon flour of Example 1 and 50% by weight of commercially available calcium/silicate de-gassing agent in the form of a powder containing 30% by weight calcium, 60% by weight silicon and 0.5% by weight carbon.

EXAMPLE 5

The procedure of Example 1 is repeated, save that contouring of the primary layer **28*a*, FIG. 4, is carried out to substantially completely remove the particulate material of that layer in the flange-defining groove so that the outer wall of that groove is defined only by a portion 29*b* of the facing layer 29*a***.

EXAMPLE 6

Figure 5:
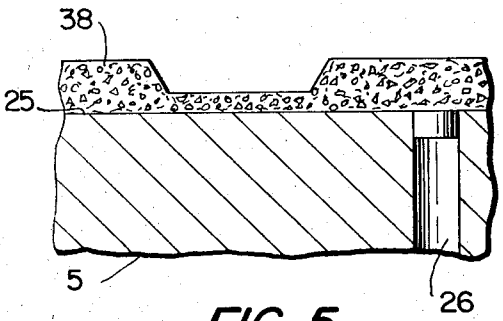
FIG. 5 is a fragmentary longitudinal cross-sectional view of a lining formed from a single refractory material according to one embodiment of the invention.

A lining consisting of a single layer 38, FIG. 5, of particles of crushed graphite of Example 1 is established by following the procedure given in Example 1 for establishing the primary layer of that example. With the mold rotating at 500 revolutions per minute, the supply trough is turned to supply the total amount of crushed graphite over a period of 30 seconds to establish a layer which, before contouring, has a radial thickness of 0.265 inch. Thus, the mold rotates 250 times as the crushed graphite is supplied, and each rotation of the mold therefore adds to the layer a covering of graphite having a thickness on the order of the average particle size of the crushed graphite. Though the particle size range for the crushed graphite is 53–600 microns, the completed layer is essentially uniform. The reason for uniformity is that, at any one instant during supply of the graphite, the amount of graphite reaching the mold or the forming layer is so small that all of the particles being supplied are fixed in place immediately by centrifugal force and therefore there is no opportunity for classification according to the wide range of particle sizes.

What is claimed is:

1. A method for producing tubular metal articles by centrifugal casting, comprising:

providing a rigid heat-conductive mold having an active mold surface of circular cross section transverse to the longitudinal axis of the mold; establishing a lining on the mold by supplying to the active surface of the mold, while the mold is rotating about it longitudinal axis, a binderless dry particulate refractory material, at least 20% by weight of the particles of the refractory material being sharp angular particles, at least 25% by weight of the particles of the refractory material being relatively large particles having a maximum dimension exceeding 75 microns, a significant portion of the particles of refractory material having a particle size which is small in comparison to said relatively large particles, the rate of rotation of the mold and the rate of supply of the particulate refractory material being such that, at the time of arrival of any increment of the particulate material at the mold surface or the surface of the forming lining substantially all of the particles are fixed in place by centrifugal force resulting from the mold rotation, the lining thus established being characterized by having at least a primary portion which is in contact with the active surface of the mold, has a significant radial thickness, and throughout the radical thickness of which said angular particles and said larger particles are uniformly distributed; the step of establishing the lining including the step of densifying the lining by rotating the mold at a predetermined rate sufficient to apply to the refractory material a centrifugal force of such magnitude that the refractory material then has an equivalent specific gravity of at least 7.5 determined according to the formula Eq. Sp. Gr. = Actual Sp. Gr. × G where G is determined by the formula $$G = \frac{[(RPM)^2 \times D]}{70{,}400}$$

where D is the inner diameter of the lining in inches;

contouring the densified lining to the shape desired for the outer surface of the article to be cast; and introducing molten casting metal into the lined mold while rotating the mold at a casting rate.

2. A method as defined in claim 1, wherein the mold is rotated at said predetermined rate while the refractory material is supplied to the mold, whereby densification of the lining occurs as the lining is being established.

3. A method as defined in claim 1 and further comprising applying to the inner surface of said lining a radially thin facing of particulate refractory material the particles of which are small in comparison to said larger particles.

4. A method as defined in claim 1 and further comprising applying to the inner surface of said lining a radially thin facing of particulate refractory material the particles of which have a thermal conductivity which is small in comparison to the thermal conductivity of said larger particles.

5. A method as defined in claim 4, wherein the article to be cast includes a first outer surface portion which is generally cylindrical and a second outer portion in the nature of an outwardly projecting flange;

the contouring step is carried out so the lining is substantially thinner in that area which is to define the flange and substantially thicker in that area which is to define said first outer surface portion; and said facing extends continuously over the area in which the lining is substantially thinner.

6. A method as defined in claim 4, wherein said facing extends over the entire lining and is substantially thicker where the facing covers the thinner portion of the lining and substantially thinner where the facing covers the thicker portion of the lining.

7. A method as defined in claim 6, wherein the lining is substantially interrupted in that area which is to define the flange.

8. A method as defined in claim 1, wherein said relatively large particles are selected from the group consisting of crushed graphite and sharp silica sand.

9. A method as defined in claim 1, wherein the lining is formed of a uniform mixture of milled refractory flour and a sand selected from the group consisting of zircon sand and silica sand, the refractory flour amounting to at least 20% of the total weight of the refractory material, and the refractory flour and sand being distributed uniformly throughout the radial thickness of the lining.

10. A method as defined in claim 1, wherein the particulate refractory material is supplied to the mold from an elongated trough which extends longitudinally through the mold when the refractory material is being supplied; and the trough is subjected to high frequency low amplitude vibration during supply of the refractory material from the trough, as the trough is turned to bring a rim of the grough to the particles, the particles at the rim of the trough are kept in motion and will flow by gravity as a thin stream over the rim without the particles locking together because of the sharp angular particles present.

11. A method as defined in claim 10, wherein said vibration of the trough is generally circumferential with respect to the trough.

12. A method as defined in claim 1 and further comprising applying to the inner surface of said lining a radially thin facing of particulate refractory material having a particle size distribution such that not more than 50% by weight of the particles have a maximum dimension greater than 150 microns, and a content of sharp angular particles equal to at least 40% by weight with at least 50% by weight of the angular particles having a maximum dimension less than 75 microns.

13. A method as defined in claim 12, wherein the particulate material of the facing consists essentially of milled refractory flour.

14. A method as defined in claim 1, wherein a first portion of the lining is in contact with the active surface of the mold; and a second portion of the lining overlies said first portion, the average particle size of the refractory material from which the first layer is formed being significantly larger than that of the refractory material from which the second portion is formed, the second portion, after densification of the lining, having distinctly greater mechanical strength than does the first portion.

15. The method for centrifugally casting a hollow iron article which has at least one right circular cylindrical outer surface portion and at least one outwardly projecting annular flange which is of substantially larger outer diameter than the cylindrical outer surface portion, comprising providing a rigid heat-conductive mold having an active mold surface of circular cross section transverse to the longitudinal axis of the mold;

establishing a lining on the mold by supplying to the mold a dry particulate refractory material, at least 25% by weight of the particles of the refractory material having a maximum dimension exceeding 75 microns, the mold being rotated to distribute the particulate refractory material over the active surface of the mold;

the step of establishing the lining including the step of densifying the lining by rotating the mold at a predetermined rate sufficient to apply to the refractory material a centrifugal force of such magnitude that that the refractory material has an equivalent specific gravity of at least 7.5 determined according to the formula $$\text{Eq. Sp. Gr.} = \text{Actual Sp. Gr.} \times G$$

where G is determined by the formula $$G + \frac{[(RPM)^2 \times D]}{70{,}400}$$

where D is the inner diameter of the lining in inches;

contouring the densified lining to shape the lining to a right circular cylindrical inner surface where the cylindrical outer surface portion of the cast article is to be formed and a groove where the outwardly projecting flange of the cast article is to be formed, the radial thickness of the lining where the outer surface portion of the cast article is to be formed being thick in comparison to the radial thickness of the lining where the flange of the cast article is to be formed;

establishing a thin facing of particulate refractory material on the inner surface of the contoured lining with the facing extending over both the thicker and thinner portions of the lining, the facing being thinner over the thicker portion of the lining and thicker over the thinner portion of the lining, the particulate material of the facing having a thermal conductivity significantly less than that of the particulate material of the lining, the thermal conductivity of the combined lining and facing being substantially uniform throughout the length of the lining; and introducing molten casting metal into the line mold while rotating the mold at a casting rate, and allowing the casting metal to solidify, the resulting cast article being characterized by containing graphite of uniform type and size throughout the length of the casting, including the flange of the cast article.

16. In a mold for producing tubular metal articles by centrifugal casting, the combination of a rigid heat-conductive mold body having an active surface which is of circular cross section transverse to the axis of rotation of the mold body; and a lining supported on the active surface of the mold body and comprising a centrifugally densified and contoured layer of binderless dry particulate material engaging the active surface of the mold body, at least 20% by weight of the particles of said densified and contoured layer being sharp angular particles and at least 25% by weight of the particles of the densified and contoured layer being larger particles having a maximum dimension exceeding 75 microns, a significant weight proportion of said sharp angular particles having a maximum dimension significantly smaller than that of said larger particle, said densified and contoured layer having substantially the same content of said larger particles in all portions of its radial thickness, said sharp angular particles being effective under the action of centrifugal force to assure that the layer retains its contoured shape despite the absence of binder and despite the presence of said larger particles, said larger particles being effective to increase permeability and heat transfer capability of the lining.

17. A mold as defined by claim 16 and further comprising a thin facing of refractory particles overlying the surface of the lining, the refractory particles of the facing being small in comparison to the refractor particles of the lining.

18. A mold as defined by claim 17, wherein the lining has a contoured inner surface including at least one transverse annular groove to define a transverse annular outwardly projecting flange on the article to be cast;

the facing portion covering said groove being thicker than the remainder of the facing, the combination of the lining and the facing having a thermal conductivity which is uniform throughout the length of the lining.

* * * * *